United States Patent [19]

Hanson

[11] Patent Number: 4,949,550

[45] Date of Patent: Aug. 21, 1990

[54] METHOD AND APPARATUS FOR MONITORING A TRANSPORT REFRIGERATION SYSTEM AND ITS CONDITIONED LOAD

[75] Inventor: Jay L. Hanson, Bloomington, Minn.

[73] Assignee: Thermo King Corporation, Minneapolis, Minn.

[21] Appl. No.: 417,149

[22] Filed: Oct. 4, 1989

[51] Int. Cl.[5] ..... F25B 49/02

[52] U.S. Cl. ..... 62/126; 62/127; 62/130

[58] Field of Search ..... 62/125, 126, 127, 128, 62/129, 130, 157, 158, 155, 160, 229, 231, 234

[56] References Cited

U.S. PATENT DOCUMENTS

| | | | |
|---|---|---|---|
| 4,045,973 | 9/1977 | Anderson et al. | 62/158 |
| 4,211,089 | 7/1980 | Mueller et al. | 62/126 |
| 4,325,224 | 4/1982 | Howland | 62/196.2 |
| 4,387,578 | 6/1983 | Paddock | 62/127 |
| 4,790,143 | 12/1988 | Hanson | 62/126 |

*Primary Examiner*—Harry B. Tanner
*Attorney, Agent, or Firm*—D. R. Lackey

[57] ABSTRACT

A monitor for a transport refrigeration unit in which the temperature of the air discharged by the unit into a load space is compared with the temperature of air returning to the unit, to provide a signal DI responsive to the algebraic difference. Signal DI, which represents the actual conditioning mode, is compared with a commanded conditioning mode signal provided by a thermostat associated with the transport refrigeration unit, and also with predetermined reference values, to detect incorrect operating modes, as well as significant loss of refrigerant capacity. Timers initiate resettable time delays in response to such detections, after which warning and shut-down signals are respectively provided when certain time delays are allowed to expire. Logic signals provided by the monitor are logically related when the monitor shuts the system down to drive diagnostic display which indicates the cause of shut down.

8 Claims, 3 Drawing Sheets

SHUTDOWN OUTPUT CONTROL
116
S
SHUTDOWN TIMER
96
WARNING OUTPUT CONTROL
114
W
WARNING TIMER
94
LOGIC
130
132
133
134
136
138
140
POWER SUPPLY
36
PAL
72
A/D
52
VCC
14
16
T1
T2
42
44 DT
MSB
IN1
IN4
IN5
IN6
IN7
IN8
IN9
IN23
OUT6
OUT5
OUT3
OUT1
A
D
N
I
S
L
H
D
10

METHOD AND APPARATUS FOR MONITORING A TRANSPORT REFRIGERATION SYSTEM AND ITS CONDITIONED LOAD

TECHNICAL FIELD

The invention relates in general to transport refrigeration systems, such as refrigeration systems for trucks, trailers and containers, and more specifically to methods and apparatus for monitoring and protecting transport refrigeration systems.

BACKGROUND ART

My U.S. Pat. No. 4,790,143 discloses methods and apparatus for monitoring and protecting both a transport refrigeration system and the associated load in the load space to be conditioned by the refrigeration system. The monitoring method and apparatus detects the temperature of the air discharged into the load space by the refrigeration system, and the temperature of the air returning to the refrigeration system from the load space, and develops an algebraic difference signal. The sign of the algebraic difference signal is used to detect improper conditioning modes. When the conditioning mode is found to be correct, the absolute value of the difference signal is used in comparisons with predetermined reference values.

The detection of an incorrect mode, as well as a comparison which determines that the difference signal does not exceed the selected reference value, initiate a first timing period. The first timing period, if not reset by a subsequent detection or comparison which indicates a return to acceptable performance, will time out and issue a warning signal to the operator of the transport refrigeration system.

The appearance of the warning signal also reduces the magnitude of the reference value which is compared with the difference signal. If, when the warning signal is issued, the actual conditioning mode is not the same as the commanded mode, a second timing period is immediately initiated. Expiration of the second timing period before a return to consistency results in a shut-down signal being generated. If the actual and commanded conditioning modes are consistent, then the second timing period is initiated when a comparison between the difference signal and the smaller reference value finds that the difference signal does not exceed the smaller reference value. If the difference signal does not increase to a value which exceeds the reference value before the second timing period expires, a shut-down signal is provided which shuts down the transport refrigeration system.

Initiation of a defrost cycle resets both timing periods so that the sum of the two timing periods may be used to detect an extended defrost cycle.

The monitoring apparatus and methods disclosed in the hereinbefore mentioned U.S. Pat. No. 4,790,143 adequately protect both the transport refrigeration system and the associated conditioned load. However, when the monitoring apparatus detects a condition that merits shutdown of the refrigeration system, the operator does not know which of several conditions caused the shutdown. Thus, it would be desirable, and it is an object of the present invention, to provide a diagnostic function which will aid the operator and/or maintenance personnel in finding and correcting the cause of the shutdown.

SUMMARY OF THE INVENTION

Briefly, the present invention logically relates a plurality of logic signals which are already present in the monitoring apparatus to provide shutdown diagnostics. The differential temperature across the evaporator coil of the transport refrigeration system to be monitored, which is a ± analog value, is converted into a digital signal, with the logic level of the MSB of the digital signal in effect indicating the algebraic sign of the difference signal. The MSB of the digital signal is a logic zero when the evaporator discharge air is colder than the return air, indicating that the actual operating mode of the refrigeration system is "cooling". The MSB of the digital signal is a logic one when the evaporator discharge air is warmer than the return air, indicating that the actual operating mode of the refrigeration system is "heating". The MSB is used as a first logic signal "A" in the diagnostic function.

A signal H from the thermostat of the transport refrigeration system indicates the "commanded" mode, ie., the mode in which the thermostat desires the refrigeration system to operate. The monitoring apparatus determines if the actual and commanded modes are consistent, providing a signal OUT3 which is a logic one when the two modes are consistent, and a logic zero when they are not. Signal OUT3 is used as a second logic signal "N" in the diagnostic function.

When the commanded and actual modes are consistent, the monitoring apparatus determines if the differential temperature across the evaporator coil is significant enough for the existing operating conditions to indicate that the system is operating properly. One of the existing operating conditions which is considered is whether or not the selected set point temperature indicates that the load being conditioned is a frozen load. This is determined by a signal L provided by the thermostat of the transport refrigeration system. Signal L is a logic zero when the selected set point indicates a non-frozen load, and a logic one when it indicates a frozen load. When signal L is a logic one, the monitoring apparatus will not shut the system down for a failure of the system to provide a heating mode, as the heating mode is locked out when the cargo is a frozen load.

The monitoring apparatus provides a signal OUT1 which is a logic one when the transport refrigeration system is operating efficiently under the existing conditions, ie., refrigeration capacity is adequate; and a logic zero when the monitoring apparatus detects a significant loss of refrigeration capacity, ie., inadequate capacity. Signal OUT1 is used as a third logic signal "I" in the diagnostic function.

When the thermostat indicates that the system should go into defrost, which is a hot gas heating mode to defrost the evaporator coil, a signal D is provided at the logic one level. Signal D is used as a fourth logic signal in the diagnostic function.

When the monitoring apparatus detects an improper operating condition, it provides a shutdown signal S at the logic one level if the condition persists for a predetermined period of time. Signal S is used as the fifth and final logic signal in the diagnostic function.

The five logic signals are logically related to provide outputs which selectively drive and latch one of four different diagnostic indicators. A first indicator "over cool" is energized upon system shutdown when the heat function of the transport refrigeration system fails when the thermostat is set above heat lockout, ie., signal L is a logic zero, indicating a fresh load as opposed to a frozen load. Energization of the "over cool" indicator is primarily determined by the inconsistent mode signal N being true (low) and the actual mode signal A being low, indicating the actual mode is cooling.

A second indicator "over heat" is energized upon system shutdown when the system is stuck in the heat mode. Energization of the "over heat" indicator is primarily determined by the inconsistent mode signal N being true (low), the actual mode signal A being high, indicating the actual mode is heating, and the defrost signal D being low, indicating the system is not in defrost.

A third indicator "extended defrost" is energized upon system shutdown when a defrost cycle persists for the combined time of the two timers in the monitoring apparatus. Energization of the "extended defrost" indicator is primarily determined by the defrost signal being true (high) at the time of system shutdown (S is high).

A fourth indicator "loss of capacity" is energized upon system shutdown when the capacity signal I is true (low) at the time of system shutdown (S is high). This indicates that during the combined time of two timers in the monitoring apparatus the temperature differential across the evaporator was not significant enough for the load temperature being maintained to indicate efficient operation.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
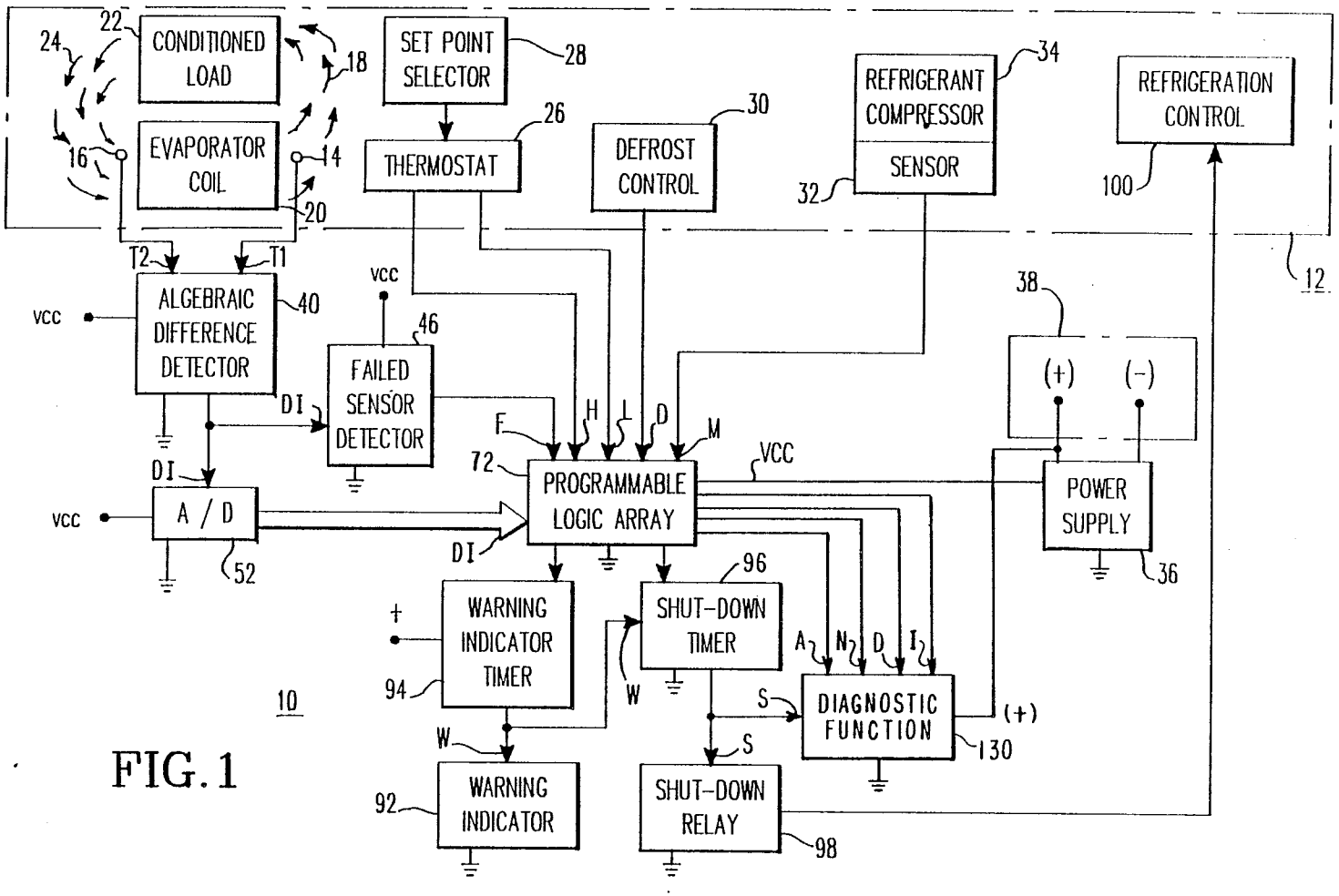
FIG. 1 is a block diagram of a refrigeration system monitor and associated diagnostic function constructed according to the teachings of the invention.

Referring now to the drawings, and to FIG. 1 in particular, there is shown a refrigeration system monitor 10 having a shutdown diagnostic function 130 for monitoring a transport refrigeration system 12. My hereinbefore mentioned U.S. Pat. No. 4,790,143 discloses a refrigeration monitor which is modified according to the teachings of the invention, and U.S. Pat. No. 4,325,224 discloses a transport refrigeration system of the type which may beneficially utilize monitor 10. These patents, which are both assigned to the same assignee as the present application, are hereby incorporated into the specification of the present application by reference. Accordingly, only those portions of monitor 10 and transport refrigeration system 12 which are necessary in order to understand the present invention are shown in the Figures. FIG. 1 is the same as FIG. 1 of incorporated U.S. Pat. No. 4,790,143, except for the addition of diagnostic function 130.

Referring now to FIG. 1, monitor 10 senses the temperature differential across evaporator coil 20, ie., the difference between the discharge and return air temperatures, using first and second external temperature sensors 14 and 16, respectively. The first sensor 14 is disposed to sense the temperature T1 of air 18 being discharged from the evaporator coil 20 into a load space 22. The load space 22 contains a load or cargo to be conditioned by refrigeration system 12, which load is in a truck, trailer, or container. Sensor 14 is preferably located in the discharge air stream 18, but may also be disposed in contact with the evaporator coil 20.

The second sensor 16 is disposed to sense the temperature T2 of air 24 returning from the conditioned load space 22 to the evaporator coil 20. Thus, sensor 16 is preferably located directly in a return air duct which directs air 24 from the conditioned load space 22 into the air entry side of evaporator coil 20.

Transport refrigeration system 12 includes a thermostat 26 which senses the temperature of the air in the conditioned load space 22 and it provides signals which request heating and cooling modes, as required to control the air temperature according to the temperature manually selected by a set point selector 28. When the set point selector 28 selects a temperature below a predetermined low value, such as 15 degrees F., for example, the heating mode is automatically locked out by thermostat 26. Below the predetermined lock-out temperature the load in space 22 will be a frozen load and it is unnecessary to prevent the temperature of the load from falling below the set point temperature. Thermostat 26 provides two logic signals H and L which are utilized by monitor 10. Signal H is a logic zero when the thermostat 26 is calling for a cooling mode, and it is a logic one when thermostat 26 is calling for a heating mode. Signal L is a logic zero when the temperature selected by set point selector 28 is above the predetermined heat lock-out temperature, and it is a logic one when the selected set point temperature is at or below the heat lock-out temperature.

Transport refrigeration system 12 also includes defrost control 30 which periodically forces system 12 into a heating mode, to remove frost and ice from the evaporator coil 20. Defrost control 30 provides a logic signal D which is utilized by monitor 10. Signal D is a logic zero when defrost control 30 is not requesting a defrosting mode, and a logic one when defrost control 30 is calling for defrost.

Figure 2:
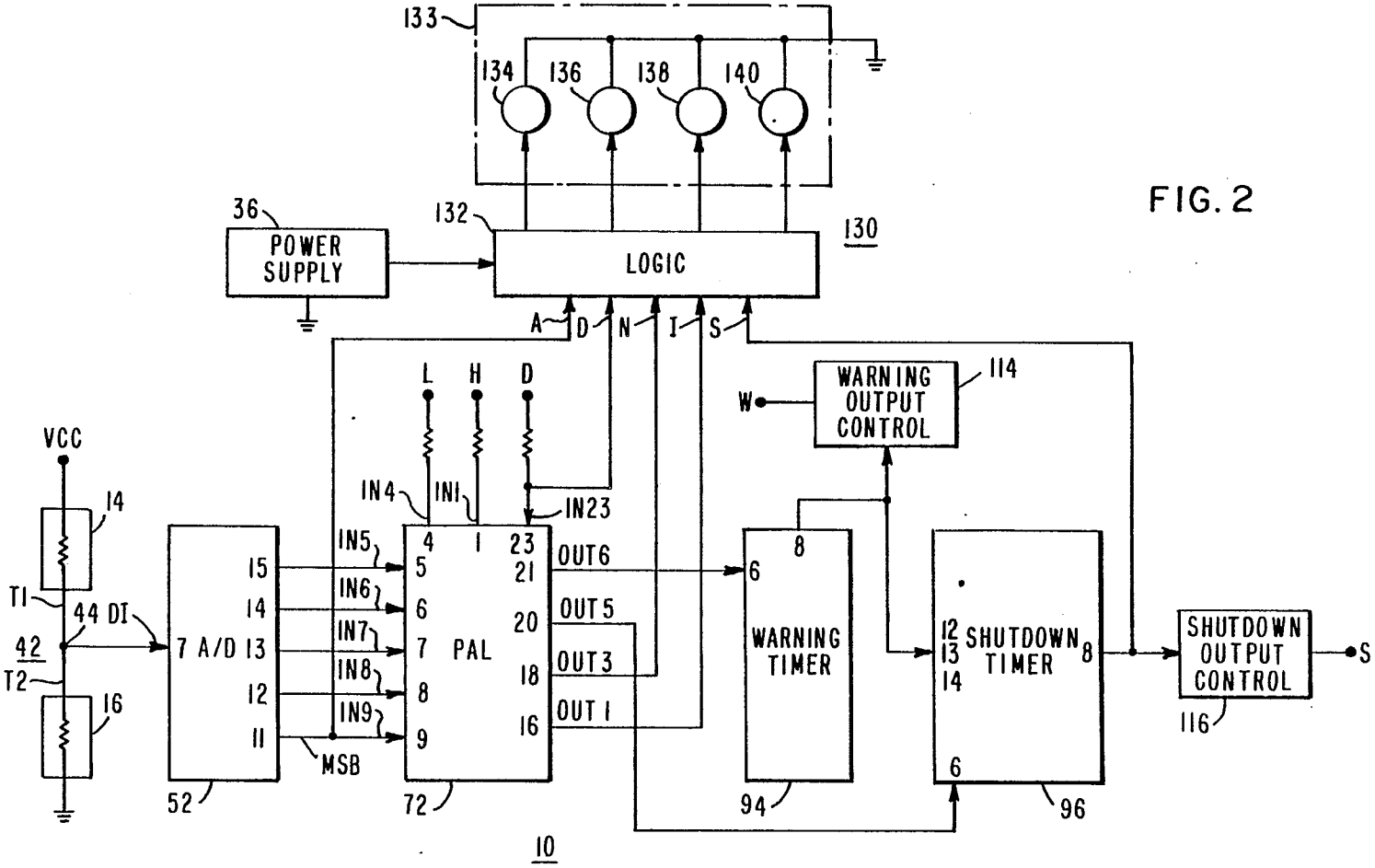
FIG. 2 is a detailed block and schematic diagram of the refrigeration system monitor shown in FIG. 1, which illustrates the derivation of the logic signals used in the diagnostic function.

The block diagram of monitor 10 in FIG. 1, and a detailed implementation of monitor 10 set forth in FIG. 2, utilize a programmable logic array, as this is the preferred implementation. However, it is to be understood that a microprocessor or discrete gate logic may be used to implement the logic of the present application, if desired.

As the block diagram of monitor 10 in FIG. 1 is described, the detailed implementation of monitor 10 set forth in FIG. 2 will also be referred to. FIG. 2 is similar to FIGS. 2A and 2B of incorporated U.S. Pat. No. 4,790,143, except simplified to show only that which is necessary to develop signals for the diagnostic function 130.

Operating voltages VCC and (+) for monitor 10 are provided by a power supply 36. Power supply 36 obtains a unidirectional voltage from a power source 38 associated with the transport refrigeration system 12, such as a conventional battery/alternator arrangement. Power source 38 may provide 12 volts, for example, with power supply 36 providing regulated and filtered voltages VCC and (+) at appropriate levels, such as five and twelve volts, respectively.

The outputs of the discharge and return air sensors 14 and 16, respectively, are applied to an algebraic difference detector 40 to obtain a differential temperature DI equal to the difference between the detected temperatures T1 and T2. For example, as shown in FIG. 2, sensors 14 and 16 may be serially connected from VCC to ground, to provide a voltage divider 42 with the difference voltage DI appearing at the junction 44 between the sensors.

The difference voltage DI is applied to an analog to digital converter (A/D) 52 to change DI from an analog value to a digital value. A/D converter 52, as shown in FIG. 2, may be a ADC0804LCN 8-bit parallel A/D converter in which the analog temperature differential DI is applied to input pin 7. The analog input is converted into digital temperature differential DI at output pins 11 through 18, with pin 11 being the most significant bit (MSB).

When the temperature T1 of the discharge air is colder than the temperature T2 of the return air, indicating a cooling mode, the analog DI will have a negative (−) sign. When the temperature T1 of the discharge air is warmer than the temperature of the return air T2, indicating a heating mode, the sign of the analog DI will be positive (+).

The digital output DI provided by A/D converter 52 is applied to a programmable logic array 72, which, for purposes of example is a P.A.L. 16L6 having 16 inputs and 6 outputs. The heat lock-out signal L, the heat signal H, and the defrost signal D, are also applied to inputs of logic array 72.

As shown in FIG. 2, the five most significant bits of digital signal DI are applied to inputs IN5 through IN9 of logic array 72, with the MSB being applied to input IN9. Signal H is applied to input IN1 of logic array 72. Signal L is applied to input IN4. Signal D is applied to input IN23.

Output OUT1 of logic array 72 is programmed to switch from high (logic one) to low (logic zero or ground) whenever the differential temperature DI is not great enough under the existing circumstances to indicate efficient operation, ie., an indication of significant loss of refrigeration capacity. For example, insufficient refrigerant charge may make it impossible for the transport refrigeration system 12 to develop a differential DI of the desired magnitude. Output OUT1 is used to provide a first logic signal I for use by diagnostic function 130.

It is the function of monitor 10 to first provide a warning indication, indicated by warning indicator 92 in FIG. 1, in response to a signal W which is provided after a predetermined time delay starting when monitor 10 first detects marginal or inefficient operation. The time delayed signal W is provided by a warning indicator timer 94. After warning signal W is provided, a second timer 96 is enabled. Timer 96, after enablement, will be activated by differential DI falling below a magnitude selected according to the smallest differential DI at which it would be desirable for refrigeration system 12 to continue operation. If differential DI continues below this smallest threshold level for a predetermined period of time, timer 96 will time out and provide a true signal S which actuates a shut-down relay 98 shown in FIG. 1. Shut-down relay 98 has contacts in refrigeration control 100, to shut down transport refrigeration system 12 before the conditioned load is undesirably frozen or cooked, or before the compressor 34 is damaged, as the case may be. It is thus the function of monitor 10 to monitor the existing conditions of the transport refrigeration system 12, and to select reference levels for comparison with differential signal DI which are compatible with the existing conditions, in order to intelligently provide a warning signal W for the operator, and a shut-down signal S for the control 100 of the transport refrigeration system 12.

If the actual or detected conditioning mode of the transport refrigeration system 12, as indicated by signal DI, is not consistent with the commanded mode as evidenced by the logic level of signal H, the warning and shut-down timing sequences will be initiated as hereinbefore described without regard to the magnitude of the differential signal DI. In other words, the sign of the actual mode signal DI is checked for consistency with the commanded mode, as one way to initiate the timing sequences. When the sign of the actual mode signal DI is consistent with the commanded mode, then the absolute magnitude of DI becomes important in determining whether or not to initiate the warning and shut-down timing sequences. Output OUT3 is programmed to go low in the event the actual conditioning mode is not consistent with the commanded mode. OUT3 is used as a second logic signal N for diagnostic function 130.

The logic level of the MSB of differential signal DI indicates the sign of DI, with the MSB being a logic zero when the discharge air is colder than the return air, indicating a cooling mode, and with the MSB being a logic one when the discharge air is warmer than the return air, indicating a heating mode. The MSB is used as a third logic signal A for the diagnostic function 130.

More specifically, when the commanded conditioning mode is calling for cooling, ie., signal H (IN1) is low, the MSB input IN9 should be logic zero. If not, OUT3 and logic signal N will go low.

When the commanded conditioning mode is calling for heating, ie., signal H is high, the MSB input IN9 should be high. If not, and the selected set point is above heat lock out (signal L and IN4 will be low), OUT3 and logic signal N will go low. It will be noted that when the commanded conditioning mode is calling for heat and heat is locked out, monitor 10 recognizes that the system is operating efficiently even though the commanded and actual conditioning modes are inconsistent.

When system 12 switches to defrost, signal D will go high. Signal D is used as a fourth logic level signal for diagnostic function 130.

Output OUT6 controls timer 94. When OUT6 is low, timer 94 will be active. When OUT6 switches high, timer 94 will clear and reset. OUT6 will go low to start timer 94 when differential signal DI does not exceed the applicable threshold value, and also when the detected conditioning mode is inconsistent with the commanded mode H.

Output OUT5 controls timer 96. When OUT5 is low, timer 96 will be active if timer 96 has been enabled by timer 94. When OUT5 switches high, timer 96 will clear and reset.

In the following description it will be assumed that timer 94 has timed out, enabling timer 96. OUT5 will go low to start timer 96 when differential signal DI does not exceed the applicable threshold value, and also when the detected conditioning mode is inconsistent with the commanded mode H. If timer 94 has not timed out, a low OUT5 existing when timer 94 times out will immediately start timer 96.

Timers 94 and 96 may be LM4541BC programmable timers, for example. For purposes of example, timers 94 and 96 are both set to time out after the input pin 6 has been held low for 45 minutes, but other timing periods may be selected. The sum of the two timing periods should be greater than the longest normal defrost cycle, in order to detect an abnormal defrost period.

Output pins 8 of timers 94 and 96 are connected to warning and shutdown controls 114 and 116, respectively, shown in FIG. 2, which may include IRFD220 N-channel Hexfets, for example. Controls 114 and 116 provide true signals W and S, respectively, when their associated timer times out. The output from pin #8 of timer 96 is used as the fifth and final logic signal for diagnostic function 130, which signal will be referred to as logic signal S.

As indicated in FIG. 2, the diagnostic function 130 includes a logic function 132 which decodes the five logic signals A, D, N, I and S to intelligently energize and latch a selected one of four shutdown indicators 134, 136, 138 and 140.

Indicator 134, termed "over cool", is energized when the thermostat set point is above heat lock out (L=0), indicating a fresh load is being conditioned, and the heat function has failed, ie., the commanded mode is heat (H=1) and the actual mode is cool (A=0). Thus, the fresh load may freeze if the system is not shut down.

Indicator 136, termed "over heat", is energized when the commanded mode is cool (H=0) and the actual mode is heat (A=1). Thus, the system is stuck in a heating mode and if it is not shut down, the load may cook.

Indicator 138, termed "extended defrost", is energized when defrost signal D is true (high) and the timers 94 and 96 have both timed out due to an improper temperature differential across the evaporator. In other words, the system will be calling for "cool" (H=0) but the discharge air is warmer than the return air (A=1). If the system shuts down for this improper temperature differential while signal D is high, it indicates an extended defrost cycle is the cause of shutdown.

Indicator 140, termed "loss of capacity", is energized when the system shuts down while signal I is a logic zero, indicting the temperature differential of the evaporator discharge and return air is not significant enough to indicate efficient operation.

Figure 3:
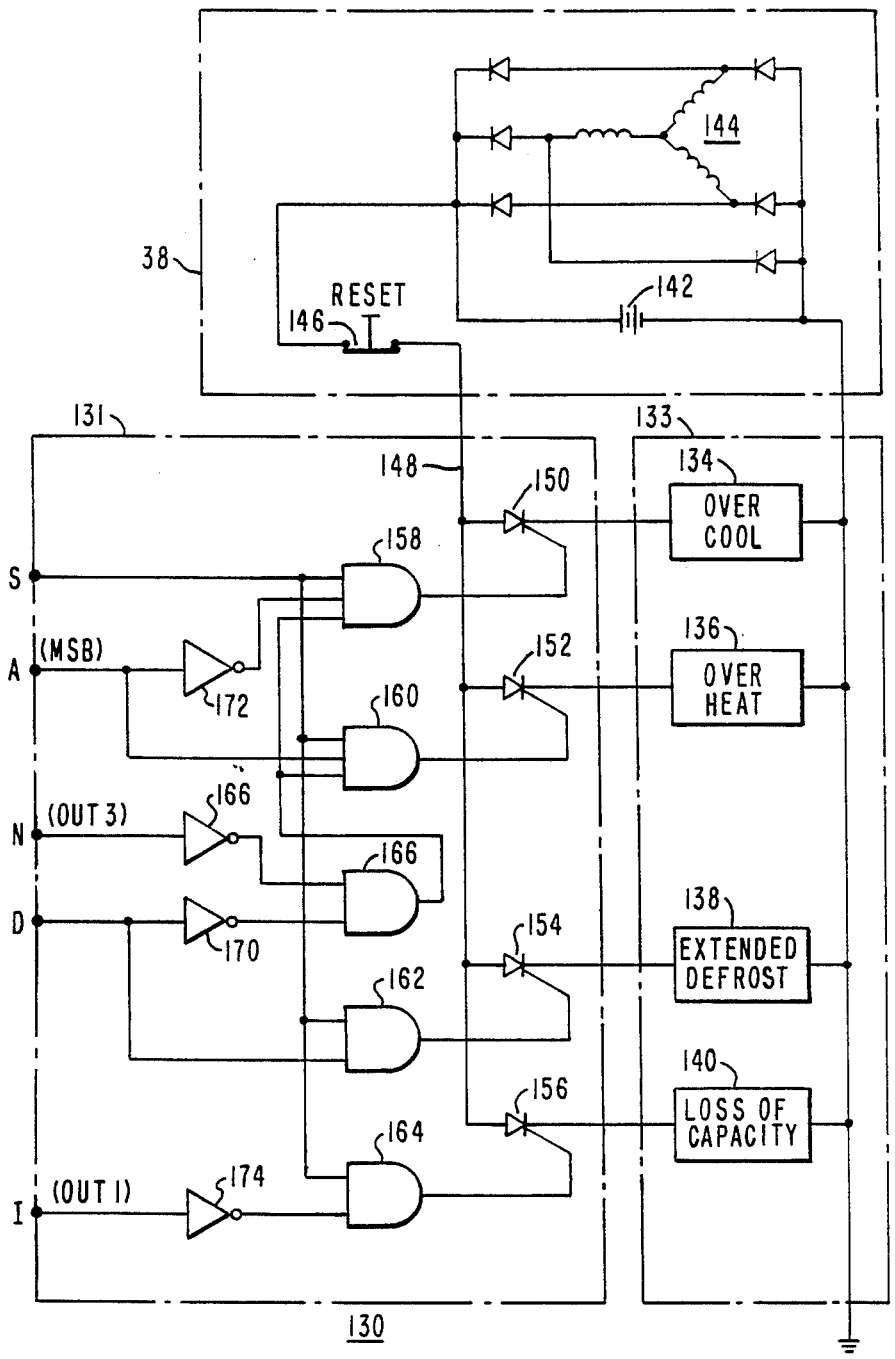
FIG. 3 is a detailed schematic diagram of a preferred implementation of a logic function shown in block form in FIG. 2.

FIG. 3 is a detailed schematic diagram of logic function 130. Logic function 130 receives "latching" power from power source 38, which source may include a battery 142, an alternator 144, and a reset switch 146. An output conductor 148 from reset switch 146 is connected to a plurality of latching switches, which may be solid state switches, such as SCR's 150, 152, 154, and 156. Conductor 148 is connected to the anode electrodes of the SCR's 150, 152, 154 and 156, and their cathode electrodes are respectively connected to indicators 134, 136, 138 and 140.

The gate electrodes of SCR's 150, 152, 154 and 156 are connected to respectively receive the outputs of AND gates 158, 160, 162, and 164. AND gates 158 and 160 have three inputs, and AND gates 162 and 164 are dual input AND gates.

The shut down signal S is applied to an input of each of the AND gates 158, 160, 162 and 164. Thus, signal S must be true (high) to enable the diagnostic function 130. An AND gate 166 receives logic signals N and D via invertor gates 168 and 170, with the output of AND gate 166 being connected to inputs of AND gates 158 and 160. The output of AND gate 166 will be high, enabling AND gates 158 and 160, only when the inconsistent mode signal N is true (low) and the system is not in defrost, ie., the defrost signal D is not true (low). Signal A, which is the MSB from the A/D converter 52, is directly applied to the remaining input of AND gate 160, and signal A is applied to the remaining input of AND gate 158 via an invertor 172.

When the system has been shut down (S is high), the system is not in defrost (D is low), and the system shut down is due to an inconsistent mode (N is low), the output of AND gate 160 will go high when signal A is a logic one, and the output of AND gate 158 will go high when signal A is a logic zero. When signal A is a logic one, indicating the actual mode is heating, the high output from AND gate 160 turns on SCR 152, energizing the "over heat" indicator 136. In like manner, when signal A is a logic zero, indicating the actual mode is cooling, the resulting high output from AND gate 158 will energize the "over cool" indicator 134.

The defrost signal D is applied to the remaining input of AND gate 162. When the system 10 is shut down while the defrost signal D is true (high), AND gates 158 and 160 will be disabled, and AND gate 162 will provide a high output, turning SCR 154 on which drives the "extended defrost" indicator 138.

The "loss of capacity" logic signal I is connected to the remaining input of AND gate 164 via an invertor gate 174. When the system is shut down while the capacity signal I is true (low), AND gate 164 will have a high output, turning SCR 156 on to energize the "loss of capacity" indicator 140.

Once energized, an indicator will remain in its energized state until the monitor 10 is reset, which resets the timers 94 and 96, and the reset switch 146 is manually depressed.

When the monitor 10 shuts refrigeration system 12 down, the operator and/or service personnel need only check the diagnostic function 130 to determine the cause of the shut down. The trouble shooting time will thus be substantially reduced, which reduces the repair time of the unit 12.

I claim as my invention:

1. A method of monitoring, and protecting a transport refrigeration system and a load in a load space to be conditioned by the transport refrigeration system, with the transport refrigeration system having a selectable set point temperature for the load space which is maintained by heating and cooling modes, comprising the steps of:

providing a signal H having a logic level indicative of whether the desired mode of the refrigeration system is heating or cooling, providing a signal D having a logic level indicative of whether or not a defrost mode is desired, detecting the temperature T1 of air discharged from the refrigeration system into the load space, detecting the temperature T2 of air returning to the refrigeration system from the load space, providing a difference signal DI equal to the difference between T1 and T2, preserving the sign of the difference, providing a logic signal A responsive to the sign of the difference wherein first and second logic levels respectively indicate actual heating and actual cooling modes, determining if the actual mode signal A is consistent with the desired mode signal H, providing a logic signal N having a logic level indicative of whether or not the actual mode signal A is consistent with the desired mode signal H, providing a shut-down signal S after a predetermined period of time when the actual mode signal A is not consistent with the desired mode signal H, logically relating the actual mode signal A, the inconsistent mode signal N, and the defrost signal D, when the shut-down signal S is provided, and providing a first diagnostic signal in response to the relating step which is indicative of a shutdown due to an extended heating cycle, when the actual mode is a heating mode, the system is not in defrost, and the actual and desired modes are inconsistent.

2. The method of claim 1 including the step of:

providing a second diagnostic signal in response to the relating step which is indicative of a shutdown due to an extended cooling cycle, when the actual mode is a cooling mode, the system is not in defrost, and the actual and desired modes are inconsistent.

3. The method of claim 2 including the steps of:

providing a logic signal I having a first logic level which indicates the differential temperature DI is significant enough under existing operating conditions to indicate adequate refrigeration capacity, and a second logic level which indicates inadequate refrigeration capacity, providing the shut down signal S a predetermined period of time after signal I indicates refrigeration capacity is inadequate, and providing a third diagnostic signal when the shut down signal S is provided while signal I is a at a logic level which indicates inadequate refrigeration capacity.

4. The method of claim 1 including the step of:

providing a fourth diagnostic signal when the shut-down signal S is provided while the defrost signal D indicates a defrost cycle is desired.

5. Apparatus for monitoring, and protecting a transport refrigeration system and a load in a load space to be conditioned by the transport refrigeration system, with the transport refrigeration system having a selectable set point temperature for the load space which is maintained by heating and cooling modes, comprising:

thermostat means providing a signal H having a logic level indicative of whether the desired mode of the refrigeration system is heating or cooling, defrost means providing a signal D having a logic level indicative of whether or not a defrost mode is desired, first temperature detector means detecting the temperature T1 of air discharged from the refrigeration system into the load space, second temperature detector means detecting the temperature T2 of air returning to the refrigeration system from the load space, difference means responsive to T1 and T2 for providing a difference signal DI having a sign and magnitude responsive to the difference between T1 and T2, means responsive to the difference signal DI for providing a logic signal A having first and second logic levels indicative of actual heating and actual cooling modes, respectively, means comparing the actual mode signal A with the desired mode signal H, and providing a logic signal N having a logic level indicative of whether or not the actual mode is consistent with the desired mode, timer means for providing a shut-down signal S when the actual mode signal A and the desired mode signal H are inconsistent for a predetermined period of time, logic means logically relating the actual mode signal A, the mode consistency signal N, and the defrost signal D, when the shut-down signal S is provided, said logic means providing a first diagnostic signal indicative of a shutdown due to an extended heating cycle, when the actual mode signal A indicates a heating mode, the defrost signal D indicates the system is not in defrost, and the mode consistency signal N indicates the actual and desired modes are not consistent.

6. The apparatus of claim 5 wherein the logic means provides a second diagnostic signal which is indicative of a shutdown due to an extended cooling cycle, when the actual mode signal A indicates a cooling mode, the defrost signal D indicates the system is not in defrost, and the mode consistency signal N indicates the actual and desired modes are not consistent.

7. The apparatus of claim 6 including:

means providing a logic signal I having a first logic level which indicates the differential temperature DI is significant enough under existing operating conditions to indicate adequate refrigeration capacity, and a second logic level which indicates inadequate refrigeration capacity, and wherein the timer means provides the shut down signal S a predetermined period of time after signal I indicates inadequate refrigeration capacity, and the logic means provides a third diagnostic signal when the shut down signal S is provided while signal I is a at a logic level which indicates inadequate capacity.

8. The apparatus of claim 7 wherein the logic means provides a fourth diagnostic signal when the shut-down signal S is provided while the defrost signal D indicates a defrost cycle is desired.

* * * * *